United States Patent [19]

Matsumoto et al.

[11] Patent Number: 4,888,264

[45] Date of Patent: Dec. 19, 1989

[54] PROCESS FOR PREPARING TONER OR CAPSULE TONER FOR USE IN ELECTROPHOTOGRAPHY

[75] Inventors: Toru Matsumoto; Toshiyuki Koshio; Yasuhide Goseki, all of Tokyo; Hisayuki Ushiyama, Hiratsuka; Masuo Yamazaki, Kawasaki; Ichiro Ohsaki, Kawasaki; Toshiaki Nakahara, Kawasaki; Junichi Kurimoto, Tokyo; Katsutoshi Wakamiya, Yokohama, all of Japan

[73] Assignee: Canon Kabushiki Kaisha, Tokyo, Japan

[21] Appl. No.: 205,540

[22] Filed: Jun. 6, 1988

Related U.S. Application Data

[63] Continuation of Ser. No. 767,866, Aug. 21, 1985, abandoned.

[30] Foreign Application Priority Data

Aug. 31, 1984 [JP] Japan ..... 59-180477
Aug. 31, 1984 [JP] Japan ..... 59-180478

[51] Int. Cl.[4] ..... G03G 9/08
[52] U.S. Cl. ..... 430/137; 430/138
[58] Field of Search ..... 430/137, 166.6, 110, 430/138

[56] References Cited

U.S. PATENT DOCUMENTS

| | | | |
|---|---|---|---|
| 4,157,974 | 6/1979 | Brechlin et al. | 252/62.1 |
| 4,363,863 | 12/1982 | Veillette et al. | 430/904 |
| 4,369,272 | 1/1983 | Jaffe | 524/564 |
| 4,610,944 | 9/1986 | Matsumoto et al. | 430/135 |

FOREIGN PATENT DOCUMENTS

| | | |
|---|---|---|
| 2352604 | 5/1974 | Fed. Rep. of Germany . |
| 123847 | 7/1984 | Japan . |
| 127060 | 7/1984 | Japan . |
| 1442835 | 7/1976 | United Kingdom . |

*Primary Examiner*—John L. Goodrow
*Attorney, Agent, or Firm*—Fitzpatrick, Cella, Harper & Scinto

[57] ABSTRACT

A mixture of a colorant, and a binder compound having an aliphatic hydrocarbon long chain and having a relatively low melt viscosity, is kneaded in a molten state in the presence of solid media such as balls or beads to form a uniform mixture in which the colorant particles or aggregates have been disintegrated to a size of 5 $\mu$ or below. Solid particles which may be used as a toner are formed from the uniform mixture and may be encapsulated, as desired, to provide a capsule toner.

23 Claims, No Drawings

PROCESS FOR PREPARING TONER OR CAPSULE TONER FOR USE IN ELECTROPHOTOGRAPHY

This application is a continuation of application Ser. No. 767,866 filed Aug. 21, 1985, abandoned herewith.

FIELD OF THE INVENTION AND RELATED ART

This invention relates to a process for preparing a toner or a capsule toner to be used in the electrophotography, electrostatic photography, magnetic recording, or electrostatic printing, and to a toner or a capsule toner to be obtained by the process.

Heretofore, various developing methods for electrophotography have been known, such as the powder cloud method, the fur brush method, the cascade developing method, and the magnetic brush developing method.

The toner used in these developing methods conventionally comprises colored fine particles each comprising a natural or synthetic resin and a dye or pigment dispersed therein. For example, in the magnetic brush developing method which is widely practiced at the present time, a two-component developer comprising iron powder called "carrier", and a toner is used. Further, a developing method using a one-component developer comprising a toner containing magnetic powder such as magnetite powder, has been developed and practiced.

An operation called "fixing" is practiced when a developed toner image is desired to be stored. As fixing methods, there are known a method in which the toner is attached through melting by heating in a heat chamber, a method in which the toner is pressure-bonded onto a surface of a support simultaneously with melting by means of hot rollers, a method in which the toner is attached by dissolving it in a solvent and thereafter removing the solvent, and a method in which the toner is fixed by means of applying a fixing agent including a resinous solution onto the toner image.

From the viewpoints, of economy of energy consumption and harmlessness to environment, the pressure-fixing method using rigid rollers, optionally with a small amount of heat, has been attracting increasing attention in recent years. This pressure fixing method is advantageous in many respects such that no fear of scorching of copied sheets is involved, that copying operation can be started immediately after turning on the power source and without requiring any waiting time, that high speed fixing is possible, and that the fixing apparatus is simple.

However, the pressure fixing method known in the art involves some vital problems. One of them is the pressure required for fixing, which is generally 130 kg/cm or above in terms of line pressure. For application of such a large force, the fixing device is required to have a considerable strength, and therefore the fixing device becomes undesirably large and heavy. Further it is extremely difficult to apply a pressure as mentioned above evenly on the transfer paper, so that the transfer paper tends to crease or curl. Another problem is that the image surface will be flattened to give rise to luster on the image and lower the quality of image, when a large pressure as mentioned above is applied on the image by rollers.

In order to overcome these problems, efforts for development of a toner or a capsule toner capable of being fixed with a low fixing pressure and low energy consumption, have been exercised.

More specifically, it has been desired to develop a practical toner or a capsule toner of low-energy consumption type, which is excellent in fixability with low energy consumption, excellent in anti-offsetting to the pressure rollers, stable in developing and fixing performances during repeated uses, with little adhesion onto carriers, metal sleeve or the surface of a photosensitive member, and also excellent in storage stability without agglomeration or caking during storage.

SUMMARY OF THE INVENTION

An object of the present invention is to provide a toner or a microcapsule toner which has excellent fixability while requiring low energy consumption, and a process for preparing the same.

Another object of the present invention is to provide a pressure fixable toner or microcapsule toner which can be fixed with a low pressure alone or optionally with a little heat, and a process for preparing the same.

Still another object of the present invention is to provide a toner or a microcapsule toner which is little influenced by change in fixing speed and is suitable for high speed fixing, and a process for preparing the same.

A further object of the present invention is to provide a toner or a microcapsule toner with little offsetting to the pressure rollers, with little adhesion onto metal sleeve or the surface of a photosensitive member, and a process for preparing the same.

A still further object of the present invention is to provide a toner or a microcapsule toner which is stable in developing and fixing performances during repeated uses and hardly causes agglomeration or caking during storage, and a process for preparing the same.

According to one aspect of the present invention, there is provided a process for preparing a toner for use in electrophotographic development, comprising: heating a mixture of 1 to 200 parts by weight of a colorant and 100 parts by weight of a binder containing a compound having an aliphatic hydrocarbon long chain, the compound having a melt viscosity of 30 cps (centipoises) or below at 100° C., stirring the heated mixture in the presence of a solid media for disintegrating an aggregate of the colorant in the mixture, to obtain a uniform mixture, and forming toner particles from the uniform mixture.

According to another aspect of the present invention, there is provided a toner obtained by the above mentioned process.

According to a further aspect of the present invention, there is provided a process for preparing a capsule toner for use in electrophotographic development, comprising: heating a mixture of 1 to 200 parts by weight of a colorant and 100 parts by weight of a binder containing a compound having an aliphatic hydrocarbon long chain, the compound having a melt viscosity of 30 cps or below at 100° C., stirring the heated mixture in the presence of a solid media for disintegrating an aggregate of the colorant in the mixture to obtain a uniform mixture, forming solid core particles from the uniform mixture, and encapsulating the solid core particles.

According to a still further aspect of the present invention provides a capsule toner prepared by the above mentioned process.

The above mentioned and other objects and features of the invention will be better understood upon consideration of the following detailed description concluding with specific examples of practice.

DETAILED DESCRIPTION OF THE INVENTION

The present invention provides a toner composed of solid particles comprising a colorant and a binder resin. The binder resin comprises a compound having an aliphatic hydrocarbon long chain and showing a melt viscosity of 1 to 30 cps at 100° C. (hereinafter, sometimes simply referred to as "long chain compound"). The colorant is uniformly dispersed in a particle size of 5μ or smaller in the binder resin. The solid particles may also be used as solid cores for a capsule toner. The solid particles constituting the toner or solid cores of the capsule toner according to the present invention should preferably have a penetration of 15 or below, particularly 5 or below in view of the durability of the toner in the developing operation.

The "penetration" used herein is measured according to the method as defined in JISK-2530. More specifically, it is a value of the depth of penetration expressed in terms of 0.1 mm as the unit when a needle having a diameter of about 1 mm and a conically shaped tip with an apex angle of 9° is caused to penetrate the sample material under a certain load. The test conditions employed in the present invention were a sample temperature of 25° C., a load of 100 g, and a penetration time of 5 seconds.

As the long chain compound having a melt viscosity of 1 to 30 cps at 150° C., there are enumerated compounds of $C_{12}$ to $C_{50}$ (i.e., having 12 to 50 carbon atoms), such as hydrocarbons, fatty acids, fatty acid esters, metal soaps, fatty alcohols, metal salts of fatty acid, fatty acid amides, fatty acid bisamides, and halogenated derivatives of the above.

More specifically, the above mentioned long-chain compounds with a carbon chain of $C_{12}$–$C_{50}$, include the following compounds.

(1) Normal- or iso-paraffins having formulas of $C_nH_{2n+2}$ (n=12–50), which can contain unsaturated bonds to such an extent not inviting ill effects thereby, as follows:

$C_{28}$ n-octacosane ($C_{28}H_{58}$),
$C_{32}$ n-dotriacontane ($C_{32}H_{66}$),
$C_{36}$ n-hexatriacontane ($C_{36}H_{74}$),
squalene ($C_{30}H_{50}$),
squalane (2.6, 10, 15, 19, 23-hexamethyl-tetracosane ($C_{30}H_{62}$)).

(2) Fatty acids having a long chain of the aliphatic hydrocarbons.

Examples of such compounds are shown in the following Table.

TABLE 1

| Saturated straight-chain fatty acids | | |
|---|---|---|
| Name | Formula | m.p. (°C.) |
| n-heptacosanoic acid | $C_{26}H_{53}CO_2H$ | 87.6 |
| montanic acid | $C_{27}H_{55}CO_2H$ | 90.0 |
| n-nonacosanoic acid | $C_{28}H_{57}CO_2H$ | 90.3 |
| melissic acid | $C_{29}H_{59}CO_2H$ | 93.6 |
| n-hentriacontanoic acid | $C_{30}H_{61}CO_2H$ | 93.1 |
| n-dotriacontanoic acid | $C_{31}H_{63}CO_2H$ | 96.2 |
| n-tetracontanoic acid | $C_{33}H_{67}CO_2H$ | 98.4 |
| ceroplastic acid | $C_{34}H_{69}CO_2H$ | 98.3–98.5 |
| n-hexatriacontanoic acid | $C_{35}H_{71}CO_2H$ | 99.9 |
| n-octatriacontanoic acid | $C_{37}H_{75}CO_2H$ | 101.6 |

TABLE 1-continued

| Saturated straight-chain fatty acids | | |
|---|---|---|
| Name | Formula | m.p. (°C.) |
| n-hexatriacontanoic acid | $C_{45}H_{91}CO_2H$ | 106.8 |

(3) Alcohols having a long chain of the aliphatic hydrocarbons. Examples are shown in Table 2 below.

TABLE 2

| Saturated alcohols | | | | |
|---|---|---|---|---|
| n | Name | Trivial Name | Formula | m.p. (°C.) |
| 26 | hexacosanol | ceryl alcohol | $C_{26}H_{53}OH$ | 79.3–79.6 |
| 28 | octacosanol | | $C_{28}H_{57}OH$ | 82.9–83.1 |
| 30 | triacontanol | melissyl alcohol | $C_{30}H_{61}OH$ | 86.3–86.5 |
| 32 | dotriacontanol | | $C_{32}H_{65}OH$ | 89.3–89.5 |

(4) Esters formed of the fatty acids and the alcohols having a long chain as described above.

(5) Chlorinated derivatives of the above described compounds, for example, chlorinated paraffins.

(6) Amides and bisamides having a hydrocarbon chain of $C_{12}$ to $C_{50}$. Examples of such compounds are shown in Table 3 below.

TABLE 3

| N,N'—Methylenebisamides | | |
|---|---|---|
| Name | Number of Carbon atoms | m.p. (°C.) |
| N,N'—methylenebis(myristic acid amide) | 29 | 151.6 |
| N,N'—methylenebis(palmitic acid amide) | 33 | 148.1 |
| N,N'—methylenebis(stearic acid amide) | 37 | 145.7 |
| N,N'—methylenebis(arachidic acid amide) | — | — |
| N,N'—methylenebis(behanic acid amide) | 45 | 141.9 |
| N,N'—methylenebis(palmitoleic acid amide) | — | — |
| N,N'—methylenebis(oleic acid amide) | 37 | 118.1 |
| N,N'—methylenebis(eicosenoic acid amide) | 41 | 122.3 |
| N,N'—methylenebis(erucic acid amide) | 45 | 123.8 |
| N,N'—methylenebis(elaidic acid amide) | 37 | 131.2 |

These compounds are used alone or in mixtures. The above described examples are commercially available as paraffin wax, microcrystalline wax, montan wax, ceresin wax, ozocerite, carnauba wax, rice wax, shellac wax, Sazol wax, metal soap, amide wax, lubricants, etc.

Examples of commercially available products include Paraffin Wax (Nippon Sekiyu K.K.), Paraffin Wax (Nippon Seiro K.K.), Microwax (Nippon Sekiyu K.K.), Microcrystalline Wax (Nippon Seiro K.K.), Hoechst Wax (Hoechst AG), Diamond Wax (Shinnippon Rika K.K.), Santite (Seiko Kagaku K.K.), Panasate (Nippon Yushi K.K.).

Representative grades of paraffin wax for example, are shown in the following Table 4 and Table 5.

TABLE 4

| Paraffin Wax and Microwax (produced by Nippon Sekiyu K.K.) | |
|---|---|
| Name | Melting point (°C.) |
| Nisseki No. 1 Candle Wax | 59.7 |
| Nisseki No. 2 Candle Wax | 62.0 |
| 145° Paraffin | 63.2 |
| Nisseki Microwax 155 | 70.0 |
| Nisseki Microwax 180 | 83.6 |

TABLE 5

| Paraffin Wax (produced by Nippon Seiro K.K.) | | | | |
|---|---|---|---|---|
| Name | m.p. | Name | m.p. | Name |
| 155 | 70 | SP-0145 | 62 | NCw-60 |
| 150 | 66 | SP-1035 | 58 | NCW-110 |
| 140 | 60 | SP-1030 | 56 | NCW-120 |
| | | SP-3040 | 63 | NCW-125 |
| | | SP-3035 | 60 | |

Other examples are:

Hoechst Wax OP (partially saponified ester wax of montanic acid, produced by Hoechst AG):

Hoechst Wax E (ester wax of montanic acid, produced by Hoechst AG):

Hoechst Wax GL3 (partially saponified synthetic wax, produced by Hoechst AG).

If necessary, vinyl resins or other polymeric materials may be used in combination with the above-mentioned compounds. Further, derivatives to be obtained by graft copolymerizing the above-mentioned compounds with vinyl monomers are preferably used. Specific examples of such derivatives include products obtained by graft copolymerizing the waxes with dimethylaminoethyl methacrylate.

In the present invention, the compounds with an aliphatic long chain having a melt viscosity of 1 to 30 cps at 100° C., are used in an amount of 30% or more, preferably 50% or more, with respect to the total amount of the binder component in the toner or the core particles of the capsule toner.

As a result of our further studies on pressure-fixable toners which can be fixed under a low pressure or with a little energy consumption, it has been discovered that a pressure-fixable toner or capsule toner capable of being fixed under a low-fixing pressure must contain a solid material in the vicinity of room temperature, and showing a low melt viscosity on heating, as a binder component. In the case of using such solid material, it has been found very difficult to disperse a colorant evenly in the binder because of aggregation of the colorant by the conventional method for dispersing a colorant which is widely used for preparing a toner. When a kneaded mixture obtained by the conventional method is cooled and thereafter pulverized into fine particles, some toner particles are found to contain no colorant therein, or to contain an aggregate of the colorant in a particle size of 5μ or larger. In the case where such a toner is used, it has been observed that ill effects are produced on toner performances such as developing property, antiadhering property, fixability, anti-offsetting property and durability.

On the contrary, the present invention can provide toner particles wherein aggregates of a colorant have been reduced into a size of 5μ or smaller, preferably 2μ or smaller.

As methods of evaluating dispersion states of colorants in a toner, there are known a method wherein toner particles are embedded in a mass of resin such as epoxy resin, sliced into a thin film by a device such as a microtome and the resultant film sample is observed through a transmission-type microscope or electron microscope; and a method wherein melt-kneaded toner material in which a colorant has been dispersed is melted and applied in a thin layer on a glass plate, and then observed through a microscope.

As the melted mixture of the long chain compound having a melt viscosity of 1–30 cps at 100° C. and the colorant for producing the toner according to the present invention has a low melt viscosity, a sufficiently large shearing force as required for effective dispersion can not be exerted to the melted mixture if the conventional dispersion method such as the three roll mill method or the biaxial extruder-type kneader is used, whereby colorant particles or aggregates having a size of 5μ or larger can frequently remain in toner particles. In such toner particles, the colorant is localized or not evenly present and the content thereof is different, particle to particle or even in a single toner particle. Because of this ununiformity of colorant distribution, the physical properties of the toner particles such as triboelectric characteristic, magnetic property, color property and smoothness become ununiform or unbalanced among toner particles, whereby several difficulties are encountered such as a color difference among toner particles due to insufficient dispersion of the colorant and a difference in hue or density between the initial stage and the final stage of repeating image-formation operations by using a copying machine. Furthermore, extreme localization or different contents of the colorant in toner particles can result in different strengths among toner particles, whereby further difficulties are encountered such that several types of adhesion or aggregation of the toner can occur or the fixing characteristic of the toner become ununiform to result in undesirable phenomena such as fixing insufficiency or offsetting.

Similarly, the localization or different contents of the colorant in toner particles lead to ununiformity in electrostatic property or magnetic property of respective toner particles, i.e., ununiformity or instability of developing characteristic or transfer characteristic of toner particles, so that undesirable phenomena such as deterioration of imaging characteristic or instability during a long run of operation, e.g., change in image density, are likely to occur.

According to the present invention, these problems are obviated through improved dispersion of the colorant, so that the toner performances are improved.

According to the process of the present invention, the mixture of a binder and a colorant is heated so that it will have a low melt viscosity of 40 ps (poises) or below, preferably 5 to 20 ps, and stirring the heated mixture while retaining its low viscosity state in the presence of solid media.

Mixing apparatus using solid media are known, such as ball mills, sand mills and attritors. With respect to these apparatus, the condition or intensity of dispersion can be changed by appropriately selecting the revolution speed, and the kind and the amount of the solid media.

The solid media to be used in the present invention for dispersion or disintegration of the colorant may preferably comprise beads or particles with a single particle size in the range of 0.5 to 20 mm, or a mixture of such beads or particles with various particle sizes. The solid media should take any shapes including spheres and irregularly shaped beads or particles.

The solid media may comprise glass beads; steel balls; siliceous sand, alumina, zirconia; plastics; ceramics; etc.

The solid media may preferably be used in a proportion of 5 to 200 parts by volume, particularly 10 to 100 parts by volume with respect to 10 parts by volume of the melt mixture.

The colorant used in the present invention may be any of known colorants used for toner production such as, for example, carbon black of various species, Aniline Black, Naphthol Yellow, Molybdenum Orange, Rhodamine Lake, Alizarin Lake, Methyl Violet Lake, Phthalocyanine Blue, Nigrosine, Methylene Blue, Rose Bengal, Quinoline Yellow and others. Such substantially nonmagnetic colorant may be used in an amount of 1 to 200 parts by weight, preferably 1 to 50 parts by weight with respect to 100 parts by weight of the binder.

For production of a magnetic toner or magnetic capsule toner, magnetic powder per se may be used as a colorant. The magnetic powder may be powder having a particle size of 1μ or below of, for example, a ferromagnetic element such as iron, cobalt, nickel or manganese, alloy or compounds containing such ferromagnetic elements. The magnetic powder may be used in combination with another colorant. The magnetic powder may be used in an amount of 1 to 200 parts by weight, preferably 15 to 70 parts by weight with respect to 100 parts by weight of the binder.

It is possible to add or mix optional additives to the toner or the capsule toner according to the present invention. Such optional additives may include carbon black, various dyes or pigments, hydrophobic colloidal silica, etc., to be used as, for example, charge controllers, flowability improvers and agents for color modification.

The average particle size of the toner or capsule toner should preferably be within the range of 3 to 20μ, preferably 5 to 10μ. It is further preferred that 50% or more of the toner particles are within the range of ±4μ from the average particle size. The capsule toner should preferably have a structure where the solid cores containing about 1 to 30 wt. %, preferably 5 to 15 wt. %, of the colorant or the magnetic solid cores as described above are coated with a relatively hard material in a thickness of 0.01 to 2μ, preferably 0.1 to 0.3μ.

After uniformly melt-mixing the binder and the colorant as described above while disintegrating the aggregates of the colorant, the mixture is formed into fine particles by a method wherein the mixture is first cooled and then comminuted by means of a so-called pulverizer, or a method wherein the mixture is comminuted as it is in the molten state and then cooled.

In the mixture of the long chain compound having a melt viscosity of 1–30 cps at 100° C. and the colorant, even if the latter is uniformly dispersed in the former, the colorant is liable to cause re-aggregation because of the low viscosity of the long chain compound. Accordingly, when the former method is used for comminution of the mixture, rapid cooling is required so as to solidify the mixture before the re-aggregation occurs. After the mixing, the mixture should preferably be dropped on a solid cooling medium or poured into a liquid cooling medium. The necessary cooling speed depends on the materials used, desired particle size or properties of the toner and the modes of mixing.

In a preferred embodiment of the present invention, the mixture of the binder and the colorant is heated to 100° C. or above so that the mixture will have a melt viscosity of 30 ps or below. The thus heated mixture at 100° C. or above is required to be cooled in a short time to reach such a state where the colorant no longer causes re-aggregation, or to be solidified. For this purpose, in a preferred embodiment, the mixture above the melt mixture at 100° C. or above is poured into crushed ice to be solidified.

Another preferred method for producing fine particles is one wherein the mixture is comminuted as it is molten and then cooled into solid particles.

In order to effect the comminution under molten state, the molten mixture is comminuted under the action of a dispersing force in various gaseous or liquid medium. More specifically, for example, the molten mixture may be dispersed in a hot gaseous stream under the action of an effluent pressure or another hot gaseous stream and recovered after cooling the gaseous stream. In another method, the molten mixture may be comminuted in a liquid medium such as hot water under the action of a stirring force, an emulsifier or a dispersion aid, and the mixture including the liquid medium may be cooled and subjected to various solid-liquid separation means to recover solid particles which may be subjected to optional treatment such as drying.

In a preferred embodiment, the molten mixture comprising a binder and a colorant which has been disintegrated into a size of 5μ or less, preferably 2μ or less and dispersed in the binder, is subjected to suspension particulation by dispersing it into hot water containing an inorganic dispersant, whereby solid particles having a narrow particle size distribution may be formed in a short time.

In another preferred embodiment, the molten mixture is dispersed in water in the presence of an inorganic dispersant while being charged (a) cationically by adding thereto a cationic compound or a hardly water-soluble or substantially water-insoluble organic amine compound or (b) anionically by the addition of an anionic compound. The inorganic dispersant is charged to a polarity opposite o that of the dispersed molten mixture particles, so that the dispersed particles are dispersed while being uniformly coated with the inorganic dispersant through ionic bonding or interaction and recovered as toner particles with a uniform particle size distribution.

According to a conventional method, a molten mixture is dispersed in hot water containing a surfactant to be recovered as particles. It is possible to obtain fine particles by this method but particles having a size much larger than and particles having a size much smaller than the desired size are also produced according to this method, so that a classification operation such as sieving is required for selectively recovering the desired size of particles. It is also difficult to remove the surfactant from the surface of the particles.

The inorganic dispersant is a hardly watersoluble or substantially water-insoluble inorganic compound in finely pulverized form, including hardly water-soluble salts such as $BaSO_4$, $CaSO_4$, $BaCO_3$, $CaCO_3$, $MgCO_3$ and $Ca_3(PO_4)_2$, inorganic macromolecular compounds such as talc, colloidal silica ($SiO_2$) bentonite ($SiO_2/Al_2O_3$), silicic acid, diatomaceous earch, clay and $SiO_2$, powder of metals or metal oxides such as aluminum oxide ($Al_2O_3$). Among these, for example, colloidal silica and bentonite are anionic inorganic dispersants, and aluminum oxide is a cationic inorganic dispersant. The inorganic dispersant shows a sufficient effect in a smaller quantity, if it is in a smaller particle size.

For example, colloidal silica having a mean primary particle size of about 40 mμ to 7 mμ exhibits a pH value of 3.6 to 4.3 at a concentration of 4% in water. Aluminum Oxide C which is an aluminum oxide product available from Degussa Co., West Germany, is very fine with a mean size of primary particles of 20 mμ and of high purity. Aluminum Oxide C exhibits an isoelectric point of about pH 9 and it is used in a neutral or acidic dispersing medium.

The inorganic dispersant, including both anionic and cationic inorganic dispersants as mentioned above, may be used in an amount of from 0.001 to 0.1 wt. phr., preferably 0.01 to 0.05 phr of the molten mixture.

Use of an inorganic dispersant having a charging characteristic opposite to that of the molten mixture according to a preferred embodiment of the present invention as described above is preferred for the following reason. Thus, in this system, the particles of the molten mixture are charged cationically or anionically at their interfaces to form stable agglomerates through interaction with the above-mentioned inorganic dispersant. In other words, the surfaces of the suspended or dispersed particles are coated completely uniformly with the inorganic dispersant firmly bonded thereto due to ionic bonding, whereby coalescence between particles can be prevented.

More specifically, for example, bentonite ($SiO_2/Al_2O_3$) and colloidal silica contain a small amount of silanol groups (—SiOH), which are dissociated in water to form $SiO^{\oplus}$ $H^{\oplus}$ and provide a negative charge. Thus, these inorganic dispersants are anionically charged in water and firmly bonded with cationically charged molten mixture particles so as to coat the surface of the molten mixture particles, whereby the re-agglomeration of the particles may be effectively avoided.

In the case of the inorganic dispersant thus firmly bonded through ionic bonding, outstanding superiority can be seen as compared with ordinary methods using a dispersant, wherein the dispersant is merely adsorbed onto the polymer particles or dispersed between particles to prevent coalescence.

For effective suspension, stirring is another important factor, and an appropriate condition for stirring is important and selected depending on the purpose, because the sizes of the particles and stability of the particles are determined thereby. More specifically, control of the particle sizes is greatly influenced by the intensity of stirring and the kind of the stirring blade amployed. Generally speaking, as the stirring is made more vigorous, particles with smaller sizes can be obtained. However, there is a lower limit with respect to the size attainable in industrial application and yield is also lowered due to entrainment of air into the stirring device.

We have made extensive studies to obtain minute particles, and consequently found that, in order to form such minute particles, it is very effective to use a dispersing device, comprising a rotary blade (turbine) having a high shearing force and rotatable at a high speed and a fixed blade (stator), which effects dispersion through powerful shearing force created between minute gaps which are precise and uniform. As examples of such a device, there are TK homomixer, TK pipeline homomixer (mfd. by Tokushu Kika Kogyo K.K.) and Microagitor (mfd. by Shimazu Seisakusho K.K.).

When the above mentioned method is used, the molten mixture is formed into particles while retaining the dispersion state attained during the melt mixing, whereby uniform particles in which the colorant is evenly dispersed may be obtained. The thus obtained solid particles have excellent properties as a toner for themselves or cores for a capsule toner.

The above mentioned effects are pronounced, especially when a colorant having a relatively large particle size is added in a large amount, for example, when a magnetic material or titanium white is used as the colorant.

We have further discussed that the above mentioned method provides solid particles with less colorant particles appearing on the surfaces thereof. This is advantageous for providing uniformization of physical properties such as electric properties, surface smoothness and chemical properties of the solid particles. Therefore, the solid particles may be effectively used not only as a toner by themselves but also cores for a capsule toner, since they can be easily encapsulated.

Thus, the solid particles as produced above may be coated with a shell-forming resin to provide a microcapsule toner. In this instance, as the solid particles have uniform surfaces, a uniform coating can be provided to form an excellent microcapsule toner.

As the shell material for the microcapsule toner according to the present invention, known resins may be available, including homopolymers of styrene and substituted derivative thereof such as polystyrene, poly-p-chlorostyrene, polyvinyltoluene and the like; styrene copolymers such as styrene-p-chlorostyrene copolymer, styrene-propylene copolymer, styrene-vinyltoluene copolymer, styrene-vinylnaphthalene copolymer, styrenemethyl methacrylate copolymer, styrene-ethyl acrylate copolymer, styrene-butyl acrylate copolymer, styreneoctyl acrylate copolymer, styrene-methyl methacrylate copolymer, styrene-ethyl methacrylate copolymer, styrenebutyl methacrylate copolymer, styrene-α-chloromethyl methacrylate, styrene-acrylonitrile copolymer, styrenevinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer and the like; polymethyl methacrylate, polybutyl methacrylate, polyvinyl chloride, polyvinyl acetate, polyethylene, polypropylene, polyester, polyurethane, polyamide, epoxy resin, polyvinyl butyral, rosin, modified rosin, terpene resin, phenol resin, aliphatic or alicyclic hydrocarbon resin, aromatic petroleum resin, urea resin, melamine resin, and so on. These resins may be used either singly or as a mixture.

The shell-forming resin should preferably have a molecular weight (number-average molecular weight) of not less than 5000, preferably 10,000 to 50,000 in view of required strength. Further, it is desirable to use a resin from which a lower molecular weight fraction has been removed, in view of storage stability under heat.

Any microencapsulation method known in the art may be applicable. For example, there may be employed the spray drying method, the drying-in-liquid method, the phase separation method and the in-situ polymerization method. A multi-layer sheel structure may also be provided in order to impart insulating property and appropriate triboelectric charging characteristic to the toner of the present invention.

In a preferred embodiment of the microencapsulation, the core material is dispersed in a solution of the shell material in a solvent, and the shell material is precipitated or deposited on the core particles to form a capsule toner comprising the core particles coated with the shell material, wherein a polymer having an ethylenically polymerized main chain and branches of a long alkyl group and an acid anhydride or its derivative unit is dissolved in the solution. The precipitation or deposition of the shell material is effected by removing the solvent by the spray drying method or by the drying-in-liquid method; or by changing the dissolving power of the solvent by way of adding a poor solvent having a poor capability of dissolving the shell material into the solution of the shell material, adding a phase separation-inducing material into the solution or changing the temperature of the system.

It has been observed that a compound having both a hydrophobic group and a polar group has some effect on the microencapsulation when it is co-present in the microencapsulation system. The use of an ordinary surfactant, however, rather binders the coating of the core material with the shell material, invites the formation of free fine particles of the shell material, or deteriorates the charging characteristic of the resultant microcapsule toner in many cases and therefore cannot be employed in the production of capsule toners.

However, when a polymer having an ethylenically polymerized main chain and branches of a long alkyl group and an acid anhydride group is used, difficulties as encountered when an ordinary surfactant is used are obviated, and the microencapsulation proceeds very smoothly.

The acid anhydride may preferably be cyclic acid anhydrides such as those of succinic acid and maleic acid. A part of the cyclic structure may be incorporated in the ethylenic main chain or the cyclic structure may form a pendant group.

An example of the polymer having a cyclic acid anhydride group incorporated in or directly connected to the ethylenic chain is an α-olefin-maleic anhydride copolymer represented by the general formula (I) below, and an example of the pendant type polymer is a polyalkenylsuccinic anhydride represented by the general formula (II) below.

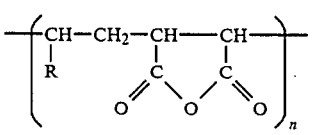

(I)

R: alkyl group having 4 to 28 carbon atoms ($C_4$–$C_{28}$)
n: polymerization degree

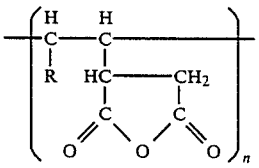

(II)

(R, n: the same as above)

The above described polymer has a hydrophobic alkyl group and an acid anhydride group with a strong polarity in combination, and therefore has a surface activity as well as a unique solubility characteristic. Those polymers having a molecular weight of the order of 8000 to 50,000 may be readily available and may suitably be used. Such a polymer having a long chain alkyl group and an anhydride group, when it is present in a solution of a shell material for microcapsulation, is capable of suppressing the thickening of the solution when the solution is condensed by removal of the solvent or phase-separation, and also capable of remarkably improving the wetting of the core material with the shell material. The thus obtained microencapsulated toner particles have uniformly smooth surfaces and are also free of agglomerates thereof or, even if some are present, they can be easily disintegrated with a small force and without causing such a difficulty that the shell material is localized onto some particles and cores of some other particles are exposed.

The effect of adding the polymer having a long chain alkyl group and an acid anhydride group appears if the polymer is used in an amount of 0.5 wt. % or more of the shell material. Excessive amount of the polymer is not desirable as fine particles formed of only the shell material are produced if the amount exceeds 30 wt. %.

The maleic anhydride group of the α-olefin-maleic anhydride copolymer is reactive with a functional group such as hydroxyl, amino and glycidyl and may cause partial reaction with a polymer having such a functional group. Accordingly, the α-olefin-maleic anhydride copolymer shows a more pronounced effect when a polymer having a polar functional groups is used as a shell-forming material.

Examples of the derivative of the α-olefin-maleic anhydride copolymer include the reaction products of the copolymer and amino compounds, epoxy compounds, alcohols and bases which react with the maleic anhydride portion of the copolymer. These derivatives show similar effects to those of the anhydride copolymer but the degree is somewhat weaker. Hydrolyzed products of these derivative exhibit intermediate effects between the anhydride copolymer and the above derivatives.

The optimum alkyl chain length of the α-olefin portion can vary depending on the properties of the core material and the shell material affecting the interfacial energy and the solvent used. When the alkyl chain is too long, the copolymer loses its solubility in ordinary solvents, and the affinity thereof with the core and shell materials is impaired. On the other hand, if the alkyl chain is too short, the polymer will lose its surface activity. While the length of $C_8$–$C_{26}$ may suitably be used regardless of the core, shell and solvent materials, the length of $C_4$–$C_{28}$ may also be suitably used when appropriate materials are used for the above components.

The toner or capsule toner according to the present invention, when it contains magnetic powder, may be used as a one-component magnetic toner. Further, the toner or capsule toner according to the present invention may be admixed with carrier particles such as iron powder, glass beads, nickel powder, and ferrite powder to form a two-component developer for developing latent images. Also, the toner can be mixed with negative or positive hydrophobic colloided silica powder for the purpose of improving free flowability, or can be mixed with abrasive particles such as cerium oxide for preventing the toner from sticking on a latent image-bearing member. Further the toner or capsule toner according to the present invention may be applicable to a developing process of a microtoning system.

The toner or capsule toner according to the present invention may be adapted for various modes of low energy fixation systems including a pressure fixation apparatus requiring a low pressure, a low-duty thermal fixation system capable of effecting fixation at lower energy consumption then before, and a low-pressure and low-heat duty fixation apparatus.

The present invention will be explained more specifically by way of working examples, wherein "part" are "parts by weight".

EXAMPLE 1

| | |
|---|---|
| Paraffin wax (Melt viscosity at 100° C.: 10 cps, m.p.: 70° C.) | 70 parts |
| Polyethylene (Melt viscosity at 100° C.: 100 cps) | 30 parts |
| Dodecylamine | 0.5 parts |
| Magnetite (primary particle size: 0.3μ) | 60 parts |

The above ingredients were heat-melted and mixed with a mixer rotating at 100 rpm for 10 minutes. The mixture was then charged into an attritor mixer (MITSUIMIKE Attritor MAISD-type) in which steel balls of 2 mm in diameter had been charged in a volume 8 times that of the mixture, and the mixture was stirred for 3 hours under the conditions of a temperature of 200° C., a melt viscosity of 18 ps, and a rotational speed of 360 rpm. After confirming that aggregates of the magnetite having a size of 5μ or above had substantially disappeared, 100 g of the thus obtained mixture after stirring was thrown into a vessel provided with a TK Homomixer and containing 3 g of Aerosil 300 and 2000 ml of water maintained at 95° C. The content of the vessel was stirred for 60 minutes by rotating the TK Homomixer at 7000 rpm initially and with gradually increasing rotational speeds. The resultant dispersion containing fine particles was thrown into 3 kg of crused ice for cooling. The fine particles were then washed with an alkaline liquid, subjected to repetition of filtration and washing and recovered after drying as fine particles to be used as a toner. The fine particles were found to have an average particle size of 13μ and 56% thereof was within the range of from 9 to 17μ.

Incidentally, the mixture constituting the fine particles was found to have a penetration of 1.

EXAMPLE 2

A capsule toner was produced in the following manner.

Thus, 100 g of the fine particles produced in the manner described in Example 1 was used as the core material of the capsule and dispersed in a solution having the following composition:

| | |
|---|---|
| Styrene-dimethylaminoethyl methacrylate copolymer (copolymerization ratio: 90/10 number-average molecular weight: about 35000) | 20 g |
| α-Olefin-maleic anhydride copolymer ($C_{16}$) (molecular weight: about 50,000) | 1.5 g |
| DMF (dimethylformamide) | 400 ml |

Then, water was gradually added dropwise into the dispersion to cause phase-separation of the styrenedimethylaminoethyl methacrylate and the α-olefin-maleic anhydride copolymer and have them coat the core material as a shell material. Then, water was further added dropwise to solidify the shell. The thus obtained capsule toner was found to have a uniform coating with a smooth surface.

The triboelectric charge of the capsule toner was measured to be +25.3 μc/g. No blocking was observed after storage for 1 week at 50° C., whereby the toner was found to have an excellent thermal stability.

The capsule toner was used for imaging by means of an electrophotographic copier (PC-10, mfd. by Canon K.K.) to obtain a clear toner image was obtained without fog on a copy paper. The thus obtained toner image on the paper was passed through a pair of pressure rollers having a line pressure of 25 kg/cm to be well fixed onto the paper. EXAMPLE 3

EXAMPLE 3

| | |
|---|---|
| Paraffin (Viscosity at 100° C.: 10 cps, m.p.: 70° C.) | 70 parts |
| Polyethylene wax (Viscosity at 100° C.: 100 cps) | 30 parts |
| Phthalocyanine blue | 10 parts |

The above ingredients were heat-melted and mixed with a mixer of 100 rpm for 10 minutes. The mixture was then kneaded for 1 hour in a sand mill in which glass beads of 2 mm in diameter had been charged. During the kneading, the mill was heated at 110° C. on an oil bath and the mixture showed a melt viscosity of 30 ps.

The kneaded mixture was withdrawn and supplied to a two-fluid nozzle heated at 200° C. and provided with a feeder of compressed air of 4 kg/cm$^2$, thereby to be atomized. The atomized product was rapidly cooled in air and collected by a cyclone. The thus obtained particles were spherical particles having an average particle size of about 12μ. Some of the particles were embedded in a mass of an epoxy resin and were sliced by a microtome into a very thin film, which was then observed through a transmission electron microscope, whereby the colorant particles were found to have a size of 1.5μ even with respect to the largest one.

The fine particles were encapsulated with a styrene-acrylic copolymer resin by the spraying method to form capsules with an average wall thickness of 0.2μ.

The thus obtained capsule particles were subjected to measurement of particle size distribution by a Coulter Counter, TA-II type, whereby the average particle size was 11.66μ and 52.2% of the particle were found to have particle sizes within a range of ±4μ from the average particle size based on the volumetric particle size distribution.

The thus obtained capsule toner was mixed with carrier iron powder with an average particle size of 200μ and was used to develop a positive electrostatic latent image, whereby a clear image was obtained. The developed toner image was transferred onto a copy paper and passed through pressure rollers having a line pressure of 25 kg/cm, whereby a well fixed toner image was obtained.

COMPARATIVE EXAMPLE 1

Core particles were prepared in the same manner as in Example 3 except that the paraffin was replaced by the polyethylene wax having a viscosity of 100 cps at 100° C. so that the whole wax was constituted thereby.

The thus obtained core particles were spheric particles with an average particle size of about 25μ, wherein a large number of phthalocyanine blue aggregates having a size of 5μ or larger were found to be present therein.

A capsule toner was produced by using the core particles in the same manner as in Example 3. The Coulter Counter measurement of the capsule toner particles thus obtained gave an average particle size of 25.3μ and showed that 43.2% of the particles fell within a particle size range of ±4μ from the average particle size based on the volumetric distribution. The imaging test gave only an unclear image and the fixed image thereof gave such a poor fixability that the toner image was lost by soft rubbing by a hand. After several sheets of imaging, the developing performance of the toner was rapidly deteriorated.

EXAMPLE 4

| | |
|---|---|
| Paraffin (Viscosity at 100° C. 10 cps, m.p.: 70° C.) | 40 parts |
| Carnauba wax (Viscosity at 100° C.: 25 cps) | 60 parts |
| Magnetite (0.3 μ) | 60 parts |

The above ingredients were heat-melted and mixed with a mixer of 100 rpm for 10 minutes. The mixture was then kneaded for 1 hour in a sand mill in which glass beads of 1.5 mm in diameter had been charged. During the kneading, the mill was heated at 120° C. on an oil bath and the mixture showed a melt viscosity of 25 ps.

The kneaded mixture was then withdrawn and charged into hot water heated at 95° C. to be dispersed therein under the action of a high-speed stirrer. The resultant dispersion was then quenched in crushed ice, and subjected to centrifugal filtration and drying to obtain solid particles.

The thus obtained particles were encapsulated by the phase separation using DMF and water as used in Example 2 to form capsules having a wall of styreneacrylic copolymer resin with an average thickness of about 0.18μ.

The Coulter Counter measurement of the capsule toner particles thus obtained gave an average particle size of 10.58μ and showed that 65% of the particles fell with a particle size range of ±4μ from the average particle size based on the volumetric distribution.

The capsule toner was applied to a developing apparatus using a magnetic sleeve, whereby a clear image was obtained. The developed toner image was transferred onto a copy paper and passed through pressure rollers having a line pressure of 17 kg/cm, whereby a well fixed image was obtained. Further, the aggregates of the magnetite in the toner were found to have a size of 2.0μ at the maximum.

COMPARATIVE EXAMPLE 2

A capsule toner was obtained in the same manner as in Example 4 except that the kneading by means of the sand mill was omitted.

The thus obtained toner particles were found to have an average size of 20.5μ, and 23% of the particles fell within a range of ±4μ from the average particle size. Further, the aggregates of magnetite in the capsule toner showed a size of 7.8μ at the maximum.

When the capsule toner was used for development in the same manner as in Example 4, only unclear images were obtained and the developing performance was rapidly deteriorated after several sheets of copying.

COMPARATIVE EXAMPLE 3

A capsule toner was obtained in the same manner as in Example 4 except that the paraffin and carnauba wax were replaced by paraffin having a viscosity at 100° C. of 0.8 cps.

The obtained toner particles were found to have an average size of 8.2μ, and 35% of the particles fell within a range of ±4μ from the average particle size.

When this toner was applied to imaging, only unclear images were obtained and, after several tens of sheets of imaging, the developing performance of the toner was rapidly deteriorated and fusion sticking of the toner was observed on the sleeve.

EXAMPLE 5

| | |
|---|---|
| Paraffin (Viscosity at 100° C: 10 cps, m.p.: 70° C.) | 80 parts |
| Polyethylene wax (Viscosity at 100° C.: 100 cps) | 20 parts |
| Raven 3500 (carbon black) | 10 parts |

The above ingredients were heat-melted and mixed with a mixer of 120 rpm for 10 minutes. The mixture was then kneaded for 1 hour in a ball mill not in which ceramic balls of 5 to 15 mm in diameter were charged. During the kneading, the pot was heated at 110° C. on an oil bath.

The kneaded mixture withdrawn was supplied to a two-fluid nozzle heated at 200° C. and provided with a feeder of compressed air, thereby to be atomized. The atomized product was rapidly cooled in air and collected. The thus obtained particles were spherical particles having an average particle size of 12μ. Some of the particles were embedded in a mass of an epoxy resin and were sliced by a microtome into a very thin film, which was then observed through a transmission electron microscope, whereby the carbon black particles were found to have a size of 1.5μ even with respect to the largest one.

The thus obtained particles were mixed with carrier iron powder with an average particle size of 100μ and was used to develop positive electrostatic latent image, whereby a clear image was obtained. The developed toner image was transferred onto a copy paper and passed through pressure rollers having a line pressure of 25 kg/cm, whereby a well fixed toner image was obtained.

EXAMPLE 6

| | |
|---|---|
| Paraffin wax (Melt viscosity at 100° C.: 10 cps, m.p.: 65° C.) | 70 parts |
| Carnauba wax | 30 parts |
| Magnetite (particle size: 0.3μ) | 60 parts |

The above ingredients were heat-melted and mixed with a mixer of 120 rpm for 10 minutes. The mixture was then kneaded in a sand mill in which glass beads of 2 mm in diameter had been charged During the kneading, the mill was heated at 120° C. by an electric heater.

The kneaded product was thrown into 2000 parts by water heated at 95° C. and containing 2 g of sodium dodecylbenzenesulfonate and dispersed under stirring at 8500 rpm. The dispersion was then quenched, subjected to repetition of filtration and washing and recovered after drying as toner particles.

The thus obtained fine particles were mixed with 0.3 part of hydrophobic colloidal silica to form a developer, which was then applied to a electrophotographic copier (NP-120, mfd. by Canon K.K.) to provide a clear image. The fixing of the toner image was also satisfactorily effected.

Further, a fixing test was conducted by replacing the fixer of the copier with an experimental fixing device providing an average line pressure of 15 kg/cm, whereby equally satisfactory results were obtained.

COMPARATIVE EXAMPLE 4

A toner was obtained in the same manner as in Example 5 except that the ball milling was omitted. The toner particles thus obtained were spherical particles having an average size of 15μ, in which aggregates of carbon black particles in the toner were found to have a size of the order of 7μ at the maximum.

When this toner was used for development, only unclear images were obtained and, during a 30-sheet continuous copying test, the image density was gradually lowered to reach a state wherein almost no image was observed. COMPARATIVE EXAMPLE 5

COMPARATIVE EXAMPLE 5

A toner was obtained in the same manner as in Example 6 except that polyethylene wax having a viscosity at 100° C. of 140 cps was used in place of the paraffin and the carnauba wax.

When this toner was used for imaging, only a low density of image was obtained and the toner image fixed under a pressure of 15 kg/cm was easily removed by rubbing with fingers. EXAMPLE 7

EXAMPLE 7

| | |
|---|---|
| Paraffin (Viscosity at 100° C. 8 cps) | 70 parts |
| Rice wax | 30 parts |
| Phthalocyanine blue | 10 parts |

The above ingredients were heat-melted and mixed with a mixer of 120 rpm for 15 minutes. The mixture was then kneaded in a sand mill in which glass beads of 1 mm in diameter had been charged. During the kneading, the mill was heated at 120° C. by an electric heater.

The kneaded product was thrown into 1000 parts of water heated at 95° C. and containing 1.8 g of silica and dispersed under high-speed stirring at 8500 rpm. The dispersion was then quenched, subjected to repetition of filtration and washing and recovered after drying as toner particles.

The thus obtained toner particles were mixed with carrier particles and used as a developer. The toner showed good developing and fixing performances and the particles of the phthalocyanine blue in the toner showed particle sizes below 3μ. COMPARATIVE

COMPARATIVE EXAMPLE 6

The procedure of Example 7 was repeated by using paraffin wax having a viscosity of 0. 8 cps at 100° C. was used in place of the paraffin was (8 cps) and the rice wax. The particles of the phthalocyanine blue in the toner showed a particle size of 3μ at the maximum, whereas the developing performance was insufficient and sticking of the toner onto the carrier particles was extensively observed.

What is claimed is:

1. A process for preparing toner particles for use in electrophotography, comprising:

(a) heating a mixture of 1 to 2000 parts by weight of a colorant and 100 parts by weight of a binder containing 30% by weight or more of a compound having an aliphatic hydrocarbon long chain, said compound having a melt viscosity of 1 to 30 centipoises at 100° C.;

(b) stirring the heated mixture containing said binder in a molten state and substantially free of a liquid medium which is liquid at room temperature, in the presence of solid media for disintegrating an aggregate of said colorant in said mixture to obtain a uniform mixture;

(c) forming particles of the uniform mixture; and (d) cooling said particles to obtain said toner particles.

2. A process according to claim 1, wherein said mixture for stirring is heated at such a temperature of 100° C. or above that the melt viscosity thereof is 40 poises or below.

3. A process according to claim 1, wherein said solid media are steel balls, glass beads or ceramic beads having a diameter of 0.2 to 20 mm.

4. A process according to claim 3, wherein said solid media are used in a proportion of 5 to 200 parts by volume per 10 parts by volume of said heated mixture.

5. A process according to claim 1, wherein said colorant is disintegrated into aggregates or primary particles of 5μ or less in size.

6. A process according to claim 1, wherein said uniform mixture is charged into hot water containing an inorganic dispersant and dispersed under the action of a shearing force, and the resultant dispersion is quenched by contact with a cooling medium to form solid particles.

7. A process according to claim 1, wherein said binder contains said compound having an aliphatic hydrocarbon long chain in a proportion of 505 by weight or more.

8. The process of claim 1 wherein the particles of said uniform mixture are formed from a molten uniform mixture.

9. A process for preparing a capsule toner having a solid core for use in electrophotography, comprising:

(a) heating a mixture of 1 to 200 parts by weight of colorant and 100 parts by weight of a binder containing 30% by weight or more of a compound having an aliphatic hydrocarbon long chain; said compound having a melt viscosity of 1 to 30 centipoises at 100° C.;

(b) stirring the heated mixture containing said binder in a molten state and substantially free of a liquid medium which is a liquid at room temperature, in the presence of solid media for disintegrating an aggregate of said colorant in said mixture to obtain a uniform mixture;

(c) forming particles of the uniform mixture;

(d) cooling said particles to obtain solid core particles; and (e) encapsulating the solid core particles with a shell material to obtain said capsule toner.

10. A process according to claim 9, wherein said mixture for stirring is heated at such a temperature of 100° C. or above that the melt viscosity there is 40 poises or below.

11. A process according to claim 9, wherein said solid media are steel balls, glass beads or ceramic beads having a diameter of 0.2 to 20 mm.

12. A process according to claim 11, wherein said solid media are used in a proportion of 5 to 200 parts by volume per 10 parts by volume of said heated mixture.

13. A process according to claim 9, wherein said colorant is disintegrated into aggregates or primary particles of 5μ less in size.

14. A process according to claim 9, wherein said uniform mixture is charged into hot water containing an inorganic dispersant and dispersed under the action of a shearing force, and the resultant, dispersion is quenched by contact with a cooling medium to form said solid core particles.

15. A process according to claim 14, wherein said solid core particles are encapsulated with the shell material through phase separation of a solution of the shell material in a solvent.

16. A process according to claim 15, wherein said solid core particles are substantially insoluble in the solvent.

17. A process according to claim 15, wherein said solution for the phase separation contains a polymer having an ethylenically polymerized main chain and branches of a long alkyl group and an acid anhydride group represented by the following formula (I) or (II):

(I)

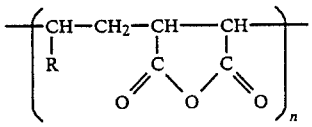

(II)

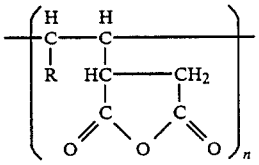

wherein R is an alkyl group having 4 to 28 carbon atoms and n is a polymerization degree.

18. A process according to claim 1, wherein said solid core particles are encapsulated by dispersing them in a solution of the shell material in dimethylformamide containing an α-olefin-maleic anhydride copolymer therein also dissolved therein, and by gradually adding water into the solution.

19. A process according to claim 9, wherein said solid core particles show a penetration of 15 or below.

20. A toner comprising solid particles each comprising a compound having an aliphatic hydrocarbon long chain and having a melt viscosity of 1 to 30 centipoises at 100° C., and colorant particles which have been disintegrated to a size of 5μ or smaller, said toner having been produced by the process according to claim 1.

21. A capsule toner comprising capsules each comprising a core material and a shell material coating the core material, said core material comprising a compound having an aliphatic hydrocarbon long chain and having a melt viscosity of 1 to 30 centiposes at 100° C. and colorant particles which have been disintegrated to a size of 5μ or smaller, the toner capsules having such a particle size distribution that 50% or more of the capsules are present in a particle size range of ±4μ from the average particle size of the whole capsules, said capsule toner having been obtained by the process according to claim 9.

22. A process according to claim 9, wherein said binder contains said compound having an aliphatic hydrocarbon long chain in a proportion of 50% by weight or more.

23. The process of claim 9 wherein the particles of said uniform mixture are formed from a molten uniform mixture.

* * * * *

UNITED STATES PATENT AND TRADEMARK OFFICE

CERTIFICATE OF CORRECTION

PATENT NO. : 4,888,264

DATED : December 19, 1989

INVENTOR(S) : TORU MATSUMOTO ET AL.

It is certified that error appears in the above-identified patent and that said Letters Patent is hereby corrected as shown below:

COLUMN 1

Line 44, "viewpoints," should read --viewpoints--.

COLUMN 5

Table 5, "155 70 SP-0145 62 NCw-60" should read --155 70 SP-0145 62 NCW-60--.

COLUMN 6

Line 38, "become" should read --becomes--.
Line 59, "apparatus" should read --apparatuses--.
Line 61, "apparatus," should read --apparatuses,--.

COLUMN 8

Line 17, "medium." should read --media.--.
Line 43, "o" should read --to--.
Line 59, "watersoluble" should read --water-soluble--.
Line 64, "colloidal silica ($SiO_2$)" should read --colloidal silica ($SiO_2$),--.
Line 65, "earch" should read --earth--.

COLUMN 9

Line 33, "$SiO^{\oplus}$ $H^{\oplus}$" should read --$SiO^{\ominus}$ $H^{\oplus}$--.
Line 52, "amployed." should read --employed.--.

COLUMN 10

Line 30, "derivative" should read --derivatives--.
Line 37, "styreneoctyl" should read --styrene-octyl--.
Line 65, "sheel" should read --shell--.

UNITED STATES PATENT AND TRADEMARK OFFICE

CERTIFICATE OF CORRECTION

PATENT NO. : 4,888,264

DATED : December 19, 1989

INVENTOR(S) : TORU MATSUMOTO ET AL.

It is certified that error appears in the above-identified patent and that said Letters Patent is hereby corrected as shown below:

COLUMN 12

Line 29, "polar functional groups" should read --polar-functional group--.
Line 38, "derivative" should read --derivatives.

COLUMN 13

Line 6, "then" should read --than--.
Line 9, ""part"" should read --"parts"--.
Line 42, "was" should read --were--.
Line 50, "was" should read --were--.
Line 61, "styrenedime-" should read --styrene-dime---.

COLUMN 14

Line 6, "image" should read --image and--.
Line 43, "particle" should read --particles--.

COLUMN 15

Line 33, "styreneacrylic" should read --styrene-acrylic--.

COLUMN 16

Line 19, "not" should be deleted.
Line 38, "was" should read --were--.
Line 53, "charged" should read --charged.--.

UNITED STATES PATENT AND TRADEMARK OFFICE

CERTIFICATE OF CORRECTION

PATENT NO. : 4,888,264

DATED : December 19, 1989

INVENTOR(S) : TORU MATSUMOTO ET AL. Page 3 of 3

It is certified that error appears in the above-identified patent and that said Letters Patent is hereby corrected as shown below:

COLUMN 17

Line 14, "COMPARATIVE EXAMPLE 5" should be deleted.
Line 23, "EXAMPLE 7" should be deleted.
Line 45, "COMPARATIVE" should be deleted.
Line 49, "was" should read --which was--.
Line 50, "paraffin was" should read --paraffin wax--.
Line 59, "2000 parts" should read --200 parts--.

COLUMN 18

Line 27, "505" should read --50%--.
Line 64, "5 μ less" should read --5 μ or less--.

COLUMN 20

Line 18, "centiposes" should read --centipoises--.

Signed and Sealed this

First Day of October, 1991

*Attest:*

*Attesting Officer*

HARRY F. MANBECK, JR.

*Commissioner of Patents and Trademarks*